US010900721B2

(12) United States Patent
Ikeda et al.

(10) Patent No.: US 10,900,721 B2
(45) Date of Patent: Jan. 26, 2021

(54) HEAT EXCHANGER AND AIR-CONDITIONING APPARATUS

(71) Applicant: Mitsubishi Electric Corporation, Tokyo (JP)

(72) Inventors: Ryoichi Ikeda, Tokyo (JP); Teruaki Konagayoshi, Tokyo (JP); Ryohei Kawabata, Tokyo (JP); Takashi Kato, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 39 days.

(21) Appl. No.: 16/318,782

(22) PCT Filed: Oct. 7, 2016

(86) PCT No.: PCT/JP2016/079942
§ 371 (c)(1),
(2) Date: Jan. 18, 2019

(87) PCT Pub. No.: WO2018/066123
PCT Pub. Date: Apr. 12, 2018

(65) Prior Publication Data

US 2019/0242659 A1 Aug. 8, 2019

(51) Int. Cl.
*F28F 9/02* (2006.01)
*F28F 1/32* (2006.01)
*F28F 1/02* (2006.01)

(52) U.S. Cl.
CPC ..... *F28F 1/325* (2013.01); *F28F 1/02* (2013.01); *F28F 1/32* (2013.01); *F28F 2215/12* (2013.01)

(58) Field of Classification Search
CPC ..... F28F 1/325; F28F 1/02; F28F 1/32; F28F 2215/12
(Continued)

(56) References Cited

U.S. PATENT DOCUMENTS 6,644,389 B1 * 11/2003 Kang ..... F28F 1/325 165/146
2013/0248150 A1 * 9/2013 Ninagawa ..... F28F 1/128 165/104.19
(Continued)

FOREIGN PATENT DOCUMENTS

JP S49-025058 U 3/1974
JP S55-141792 U 10/1980
(Continued)

OTHER PUBLICATIONS

Office Action dated Mar. 5, 2020 issued in corresponding CN patent application No. 201680089805.5 (and English translation).
(Continued)

*Primary Examiner* — Claire E Rojohn, III
(74) *Attorney, Agent, or Firm* — Posz Law Group, PLC

(57) ABSTRACT

A heat exchanger includes: a heat-exchanger core which includes flat fins each having a plurality of cuts arranged on one side of each flat fin and allowing heat transfer tubes to be inserted into the cuts, and which has a recess on the other side of the flat fins; and a heat-exchanger core having protrusions which fits in the recesses. The heat-exchanger core also includes flat fins each of which has a plurality of cuts allowing heat transfer tubes to be inserted into the cuts, and also each of which has protrusions on a side of the fin; and a heat-exchanger core having recesses which allow the protrusions to fit in the recesses.

10 Claims, 4 Drawing Sheets

(58) Field of Classification Search
USPC ..... 165/173
See application file for complete search history.

(56) References Cited

U.S. PATENT DOCUMENTS

| | | | | |
|---|---|---|---|---|
| 2013/0276305 | A1* | 10/2013 | Nissen | F28F 21/084 29/890.043 |
| 2013/0306295 | A1* | 11/2013 | Pierce | F28F 13/00 165/185 |
| 2014/0338876 | A1* | 11/2014 | Hokazono | F28F 1/126 165/181 |
| 2016/0146551 | A1* | 5/2016 | Kolb | F28D 1/0417 165/173 |
| 2017/0045305 | A1* | 2/2017 | Contet | F28D 1/05383 |
| 2017/0205085 | A1* | 7/2017 | Lu | F28D 1/0435 |
| 2019/0162492 | A1* | 5/2019 | Kurosaki | F28F 1/022 |
| 2019/0178591 | A1* | 6/2019 | Shiomi | F28F 1/32 |

FOREIGN PATENT DOCUMENTS

| | | | | |
|---|---|---|---|---|
| JP | H05-164487 | A | | 6/1993 |
| JP | H07-103678 | A | | 4/1995 |
| JP | 2004-198094 | A | | 7/2004 |
| JP | 4845943 | B2 | | 12/2011 |
| JP | 2012-032121 | A | | 2/2012 |
| JP | 2013-204855 | A | | 10/2013 |
| JP | 2013-221713 | A | | 10/2013 |
| JP | 2013204855 | A | * | 10/2013 |
| JP | 2014228236 | A | * | 12/2014 |
| JP | 2016-121839 | A | | 7/2016 |

OTHER PUBLICATIONS

Office Action dated Jan. 14, 2020 issued in corresponding JP patent application No. 2018-543554 (and English translation).
International Search Report of the International Searching Authority dated Dec. 20, 2016 for the corresponding International application No. PCT/JP2016/079942 (and English translation).

* cited by examiner

HEAT EXCHANGER AND AIR-CONDITIONING APPARATUS

CROSS REFERENCE TO RELATED APPLICATION

This application is a U.S. national stage application of International Application No. PCT/JP2016/079942, filed on Oct. 7, 2016, the contents of which are incorporated herein by reference.

TECHNICAL FIELD

The present invention relates to a heat exchanger and an air-conditioning apparatus provided with the same.

BACKGROUND

Heat exchangers each include a heat-exchanger core in which heat transfer tubes are inserted into stacked flat fins, and efficiently cause heat exchange to be performed between refrigerant flowing through the heat transfer tubes and outdoor air in the heat-exchanger core. As examples of the heat transfer tubes, for example, cylindrical tubes and flat tubes are present. The cylindrical tubes have a circular cross-section, and the flat tubes have a cross section formed in the shape of a rectangle having rounded corners. In the following description, a heat exchanger including cylindrical tubes will be referred to as "cylindrical-tube heat exchanger", and a heat exchanger including flat tubes will be referred to as "flat-tube heat exchanger".

As a method for manufacturing a heat-exchanger core of a flat-tube heat exchanger, it is known that heat transfer tubes are press-fitted into U-shaped cuts of flat fins, the U-shaped cuts being each in a width direction of each flat fin from one side thereof. In some of the flat-tube heat exchangers, such heat-exchanger cores as described above are joined to each other in the width direction of flat fins, whereby the heat-exchanger cores are combined into a single heat exchanger (for example, Patent Literature 1 e).

PATENT LITERATURE

Patent Literature 1: Japanese Patent No. 4845943

In each of such heat exchangers as described above, heat-exchanger cores are joined to each other in the width direction of fins, thereby forming a single heat exchanger. However, the heat-exchanger cores are displaced from each other.

SUMMARY

The present invention has been made to solve the above problem, and an object of the invention is to reduce or prevent the displacement of heat-exchanger cores.

In a heat exchanger according to an embodiment of the present invention which includes a plurality of heat-exchanger cores each including flat fins arranged in a direction in which passages provided in heat transfer tubes extend, recesses formed in at least one of the heat-exchanger cores and protrusions of another one of the heat-exchanger cores are engaged with each other.

In the heat exchanger according to the embodiment of the present invention, protrusions of a heat-exchanger core are fitted in recesses of another heat-exchanger core, thereby reducing or preventing displacement of the heat-exchanger cores.

DETAILED DESCRIPTION

Embodiment 1

A heat exchanger according to the present invention includes a plurality of heat-exchanger cores joined to each other. In the heat exchanger, when the heat-exchanger cores are joined to each other, they are prevented from being displaced from each other, or such displacement is reduced.

Embodiment 1 of the present invention will be described below. With respect to embodiment 1, a heat exchanger including flat heat transfer tubes and an outdoor unit of an air-conditioning-apparatus provided with the heat exchanger will be described.

Figure 1:
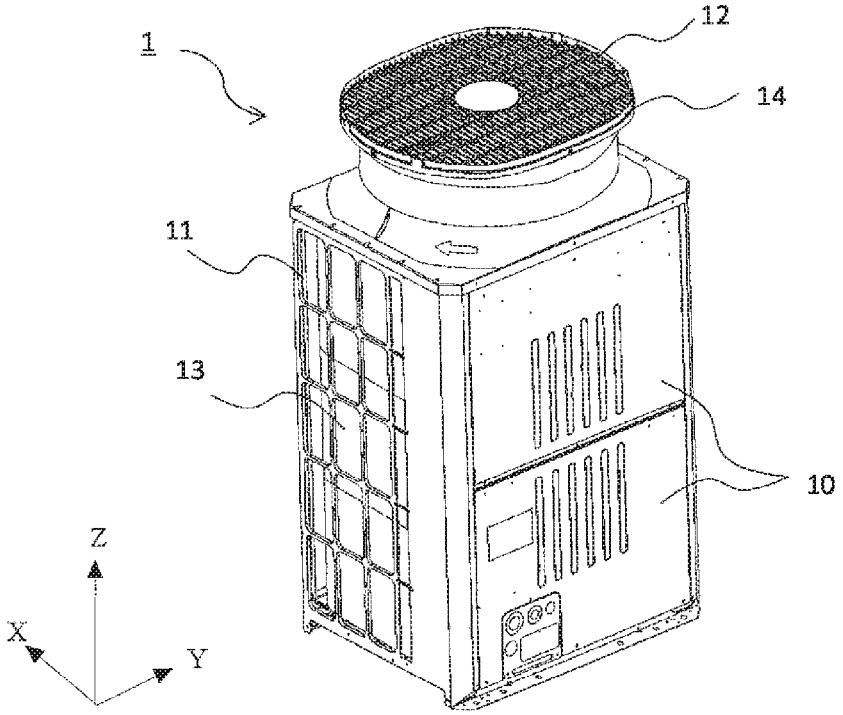
FIG. 1 is a perspective view of an outdoor unit of an air-conditioning-apparatus according to the present invention.
Figure 2:
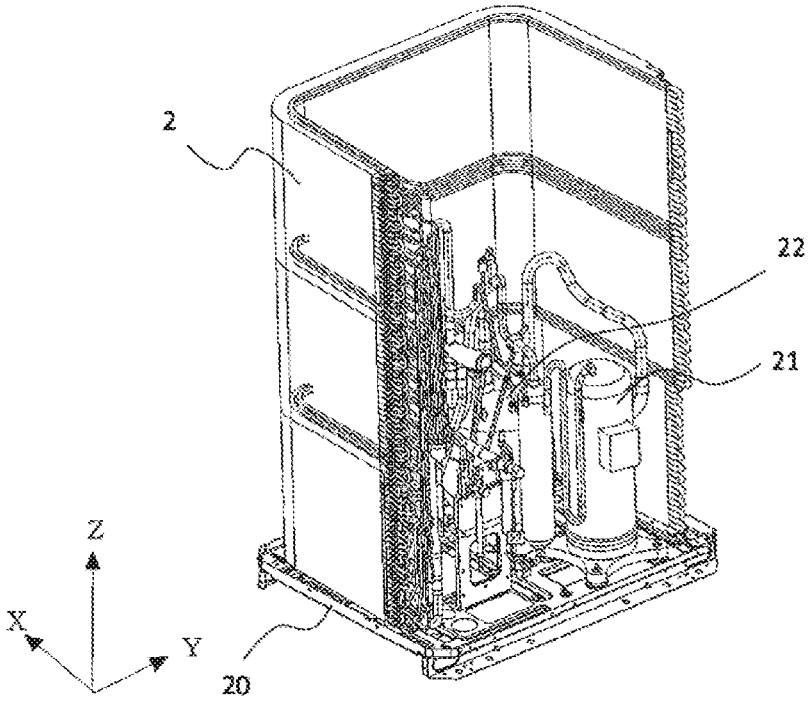
FIG. 2 is a perspective view of the inside of the outdoor unit according to the present invention.

The configuration of an outdoor unit 1 of an air-conditioning apparatus will be described. FIG. 1 is a perspective view of the outdoor unit 1 including a heat exchanger 2 according to embodiment 1 of the present invention. FIG. 2 is a perspective view of the inside of the outdoor unit 1. As illustrated in FIGS. 1 and 2, the outdoor unit 1 includes the heat exchanger 2, etc., provided therein, and is covered by an outer casing including a plurality of panels. It should be noted that X denotes the depth direction of the outdoor unit 1, Y denotes the width direction of the outdoor unit 1 and Z denotes the height direction of the outdoor unit 1.

The outer casing of the outdoor unit 1 includes front panels 10 corresponding to a front surface of the outer casing, side panels 11 corresponding to side surfaces of the outer casing, and a fan guard 12 provided on an upper portion of the outdoor unit 1. The side panels 11 each include an air inlet 13 through which air is taken into the outdoor unit 1. The fan guard 12 includes an air outlet 14 through which air is discharged out of the outdoor unit 1.

A fan is provided in the fan guard 12 on the upper portion of the outdoor unit 1. The fan takes air into the outdoor unit 1 through the air inlet 13, and discharges the taken air from the outdoor unit 1 to the outside thereof through the air outlet 14. The fan is surrounded by the fan guard 12. By virtue of this configuration, air taken in the outdoor unit 1 through the air inlet 13 passes through the heat exchanger 2, and is then is discharged from the outdoor unit 1 to the outside thereof through the air outlet 14.

In the outdoor unit 1, the heat exchanger 2, a base panel 20, a compressor 21 and an accumulator 22 are provided. The base panels 20 supports the heat exchanger 2, etc. The compressor 21 compresses refrigerant. The accumulator 22 stores surplus refrigerant.

The base panel 20 corresponds to the bottom of the outer casing of the outdoor unit 1. The components provided in the outdoor unit 1 are screwed to the base panel 20 and thus supported thereby. The compressor 21 compresses the refrigerant and discharges it, and is provided on the base panel 20. In a cooling operation, a refrigerant discharge side of the compressor 21 is connected to the heat exchanger 2, and in a heating operation, the refrigerant discharge side is connected to a heat exchanger included in an indoor unit not illustrated. The accumulator 22 stores surplus liquid refrigerant, and is connected to a refrigerant suction side of the compressor 21.

Figure 3:
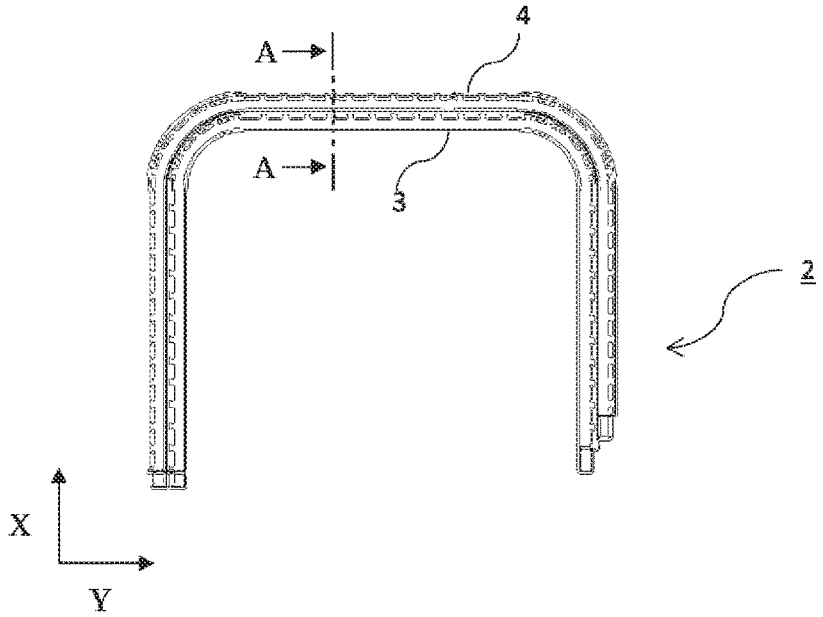
FIG. 3 is a top view of a heat exchanger according to the present invention.

FIG. 3 is a top view of the heat exchanger 2. The heat exchanger 2 includes heat transfer tubes each containing a refrigerant passage through which the refrigerant passes, and fins provided in contact with the heat transfer tubes. The heat exchanger 2 causes heat exchange to be performed between the refrigerant supplied to the heat transfer tubes and air passing between the fins. In the cooling operation, the heat exchanger 2 functions as a condenser (radiator) to condense and liquify the refrigerant and in the heating operation, the heat exchanger 2 functions as an evaporator to evaporate and gasify the refrigerant. The heat exchanger 2 is located to face the side panel 11, and fixed to the side panel 11.

The heat exchanger 2 according to embodiment 1 of the present invention includes heat-exchanger cores 3 and 4 in each of which flat tubes are inserted in flat fins. That is, the heat-exchanger cores 3 and 4 are joined to each other in the width direction of the flat fins to form the heat exchanger 2. The flat tubes are each bent in the U-shape. One end of each of the flat tubes is a hairpin portion having a U-shape, and the other end thereof is a cut portion formed in the shape of the cross-section of the flat tube.

Each flat tube is, for example, a flat multi-hole tube containing a plurality of refrigerant passages. Preferably, the flat tube should be formed of corrosion-resistant metal having good heat conductivity. For example, the flat tube can be considered formed of aluminum or copper. The flat tube through which a fluid, such as refrigerant, flows, has an elongated cross-section, as a result of which a contact area between the refrigerant and the heat transfer tube can be increased without increasing the resistance to air passing through the heat exchanger. As a result, even if the heat exchanger is made smaller, it can obtain a sufficient heat exchange performance.

FIG. 2 illustrates three heat exchangers 2 which are arranged in a vertical direction in the outdoor unit 1, and in each of which flat tubes are arranged in columns. However, the configuration of the heat-exchanger cores of the heat exchanger 2 is not limited to such an example. For example, a single heat exchanger 2 may be provided, or a plurality of heat exchangers 2 may be arranged.

Figure 4:
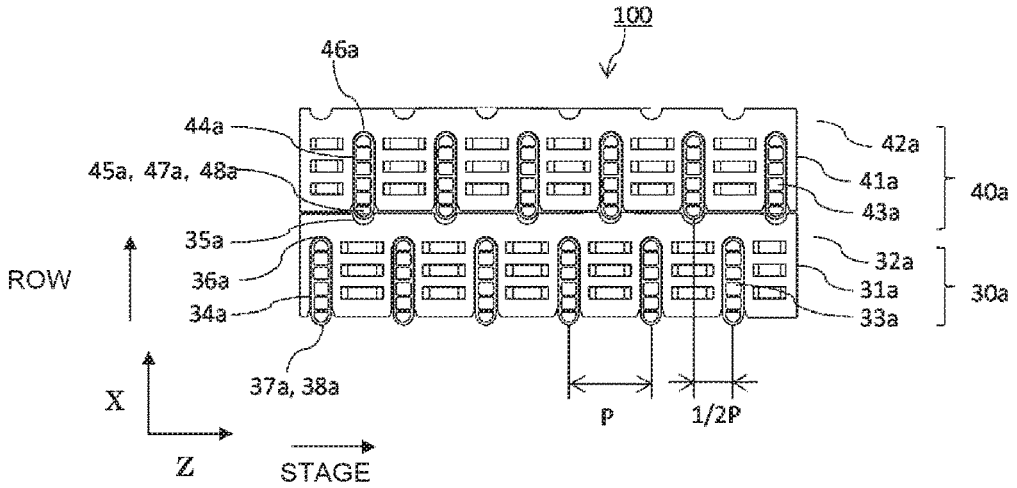
FIG. 4 is a sectional view of part of a heat exchanger according to embodiment 1.

FIG. 4 is a sectional view of part of the heat exchanger 2 (the heat exchanger as illustrated in FIG. 4 will be referred to as heat exchanger 100), which is taken along line A-A in FIG. 3. In FIG. 4, the X direction is a direction in which the heat-exchanger cores are arranged in a row, and the Z direction is a direction in which stages of the heat-exchanger cores are arranged. The heat exchanger 100 includes a heat-exchanger core 30*a* serving as a first heat-exchanger core provided with recesses and a heat-exchanger core 40*a* serving as a second heat-exchanger core provided with protrusions. To be more specific, in the heat exchanger 100, the heat-exchanger core 30*a* and the heat-exchanger core 40*a* are joined to each other.

The heat-exchanger core 30*a* provided with the recesses includes heat transfer tubes 33*a* and a fin body 32*a* in which flat fins 31*a* are arranged. Each of the flat fins 31*a* has a plurality of cuts 34*a* which are spaced apart from each other and arranged at regular intervals, and which are formed on one side of each flat fin 31*a* which is located at one end in a longitudinal direction thereof, and further includes a plurality of recesses 35*a* formed on the other side of each flat fin 31*a*, which is located opposite to the above one side. The cuts 34*a* are elongated and allow the heat transfer tubes 33*a* to be inserted into the cuts 34*a*. The recesses 35*a* are forward or backward offset relative to the cuts 34*a* by half a pitch P of the cuts 34*a*, that is, by ½P, in a direction in which the cuts 34*a* are arranged. The recesses 35*a* are semicircular. The flat fins 31*a* are arranged in a direction in which the passages in the heat transfer tubes 33*a* extend (or in a direction perpendicular to the plane of FIG. 4), thus forming the fin body 32*a*. The heat transfer tubes 33*a* are inserted into in the cuts 34*a* of the fin body 32*a*, thus forming the heat-exchanger core 30*a* having the recesses. As illustrated in FIG. 4, the heat transfer tubes 33*a* are inserted in the cuts 34*a* such that one-end portions of the heat transfer tubes 33*a* are in contact with deepest portions 36*a* of the cuts 34*a*, and arcuate portions 38*a* which are other-end portions of the heat transfer tubes 33*a*, protrudes from the cuts 34*a*, and serves as semicircular protrusion portions 37*a*. The protrusion portions 37*a* form protrusions of the heat-exchanger core 30*a*.

The heat-exchanger core 40*a* having protrusions 45*a* has the same configuration as or a similar configuration to that of the heat-exchanger core 30*a*, except for the configurations of both end portions of the flat fins in a direction along the long sides thereof. The heat-exchanger core 40*a* includes heat transfer tubes 43*a* and a fin body 42*a* in which flat fins 41*a* are arranged. Other-end portions of the heat transfer tubes 43*a* protrude from cuts 44*a*, and serve as semicircular protrusion portions 47*a*. The protrusion portions 47*a* form the protrusions 45*a* which fit in the recesses 35*a* of the heat-exchanger core 30*a*.

In the heat exchanger 100 having the above configuration, the semicircular protrusions 45*a*, which are the protrusion portions of the heat transfer tubes 43*a* in the heat-exchanger core 40*a*, fit in the semicircular recesses 35*a* provided in the heat-exchanger core 30*a*, whereby the heat-exchanger core 30*a* and the heat-exchanger core 40*a* are joined to each other to have a desired positional relationship.

In the above case, the recesses 35*a* of the heat-exchanger core 30*a* are forward or backward offset relative to the cuts 34*a* by half the pitch P of the cuts 34*a*, i.e., ½P, in the direction in which the cuts 34*a* are arranged. Since the protrusions 45*a* of the heat-exchanger core 40*a* fit in the recesses 35*a*, the positional relationship between the heat transfer tubes 33*a* of the heat-exchanger core 30*a* and the heat transfer tubes 43*a* of the heat-exchanger core 40*a* are arranged in a staggered manner.

The heat transfer tubes and the flat fins of each heat-exchanger core are joined by, for example, brazing or bonding. Cladding material including a layer of a brazing material is applied to the heat transfer tubes or the flat fins or both the heat transfer tubes and the flat fins, to thereby join them to each other by brazing. If material which does not contain a brazing material layer is used, a brazing material or an adhesive is applied, and the heat transfer tubes and the flat fins are joined by brazing or bonding. In a joining method using brazing, the heat transfer tubes are joined to the flat fins by furnace brazing in which brazing is performed in a high-temperature atmosphere furnace.

Contact part of each flat fin to be in contact with an associated heat transfer tube is formed to include raised part which is called a fin collar or a burr, and is raised from a flat surface of the fin. Thereby, the heat transfer tubes are more firmly joined by brazing to or bonded to the flat fins.

A method of assembling the heat exchanger 100 will be described. The heat exchanger 100 is assembled by stacking a plurality of heat-exchanger cores together in the column direction as indicated in FIG. 4. This assemblage may be performed before or after the heat transfer tubes and the flat fins of each heat-exchanger core are joined by, for example, brazing, in the above manner. After the heat-exchanger cores are assembled into the heat exchanger 100, the heat exchanger may be bent into a desired shape, for example, a substantially U-shape as illustrated in FIG. 3 or a substantially L-shape.

In joining the heat transfer tubes 33*a* to the flat fins 31*a* and joining the heat transfer tubes 43*a* to the flat fins 41*a*, there is a case where the heat-exchanger core 30*a* and the heat-exchanger core 40*a* are joined to each other by a brazing material or an adhesive. If the heat-exchanger core 30*a* and the heat-exchanger core 40*a* are joined together, it is impossible to attach components between the heat-exchanger cores. Furthermore, when the assembled heat exchanger 100 are bent into a substantially U-shape or L-shape, displacement of the heat-exchanger cores in a direction where the fins are arranged occurs, since the heat-exchanger cores have different bend radii. In this case, if the heat-exchanger core 30*a* and the heat-exchanger core 40*a* are joined together, displacement of the heat-exchanger cores is reduced or prevented, and it is therefore hard to bend the heat exchanger into a substantially U-shape or L-shape.

As a method of preventing the heat-exchanger core 30*a* and the heat-exchanger core 40*a* from being joined together, there is provided a method of inserting a joining prevention sheet between the heat-exchanger cores. In the case where the above joining is performed by the furnace brazing, if as the above joining prevention sheet, a joining prevention sheet containing carbon fiber is used, and can be removed after the joining is performed by the furnace brazing. By virtue of use of the joining prevention sheet, the heat-exchanger core 30*a* and the heat-exchanger core 40*a* can be assembled into the heat exchanger such that the heat-exchanger cores are not joined together.

The assemblage of the heat exchanger 100 is performed on a workbench or a platform car. The heat-exchanger core 30*a* is connected to the heat-exchanger core 40*a* by attaching components for connecting the heat transfer tubes 33*a* and 43*a* together to cut portions of the heat transfer tubes 33*a* and 43*a*. As connection methods, the following methods are present: U-bend connection for connecting a pair of heat transfer tubes; header-connection; and distributor-connection. In the header-connection or distributor-connection, a main passage is connected to heat transfer tubes. To connect a cut end of a flat tube to, for example, a header, a distributor, or a cylindrical tube, an element called a joint which switches the passage to be used from the cylindrical tube to the flat tube may be used.

These connecting elements are attached to the heat transfer tubes by the furnace brazing, burner brazing in which a base material and a brazing material are burned with flames from a burner, or high-frequency brazing.

In a conventional heat exchanger, in the case of assembling a plurality of heat-exchanger cores, it is necessary to accurately position the heat-exchanger cores by joining sides of flat fins of the heat-exchanger cores, which extend in the width direction of the fins, or joining hairpin portions and cut ends of heat transfer tubes of the heat-exchanger cores. Therefore, the heat-exchanger cores are assembled using a positioning plate or jig.

Furthermore, even after the heat-exchanger cores are assembled and positioned, in the case where they are subjected to brazing, they are displaced from each other. It is therefore necessary to reduce displacement of the heat-exchanger cores by using the same positioning jig as in assemblage of the heat-exchanger cores, or another positioning jig, or connecting members.

The heat exchanger 100 according to embodiment 1 includes the heat-exchanger cores 30*a* and the heat-exchanger core 40*a*. The heat-exchanger core 30*a* includes the cuts 34*a* each of which is formed on one side of an associated one of the flat fins 31*a*, and which allow the heat transfer tubes 33*a* to be inserted into the cuts 34*a*, and the recesses 35*a* each of which is formed on the other side of the associated one of the flat fins 31*a*. The heat-exchanger core 40*a* includes the protrusions 45*a* each of which is formed on an associated one of the flat fins 41*a*, and which fit in the recesses 35*a*. By virtue of this configuration, since the protrusions 45*a* fit in the recesses 35*a*, it is possible to reduce or prevent displacement of the heat-exchanger cores, and easily position the heat-exchanger cores of the heat exchanger 100. Therefore, the heat-exchanger cores are easily positioned and assembled into the heat exchanger 100 without using a positioning plate or jig.

The recesses 35*a* are formed by partially cutting the flat fins 31*a*, and the protrusions 45*a* correspond to the protrusion portions 47*a* of the heat transfer tubes 43*a*. Thus, the number of elements for connecting the heat-exchanger cores or connecting the heat exchanger and a housing can be reduced. It is therefore possible to facilitate assemblage of components, reduce the time required for assemblage of the components, and also reduce the cost.

Furthermore, it is possible to reduce displacement of the heat-exchanger cores after they are assembled, and thus reduce the number of components for connecting the assembled heat-exchanger cores to each other. Also, it is possible to reduce deterioration of the performance of the heat exchanger 100, since staggered arrangement of the heat-exchanger cores is not broken. Because of this staggered arrangement of the heat-exchanger, air passing through an area of the inside of the heat exchanger 100, which is located outside the heat transfer tubes, is stirred, and results in turbulent flow. As a result, the coefficient of heat transfer of the heat exchanger 100 is improved.

Figure 5:
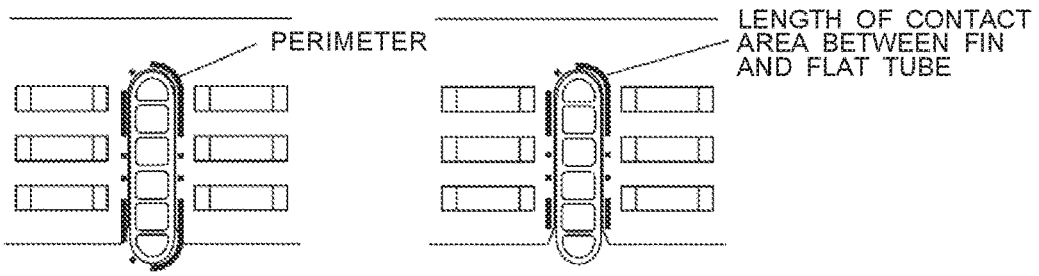
FIG. 5 is an enlarged sectional view of part of a flat fin of the heat exchanger according to embodiment 1.
Figure 6:
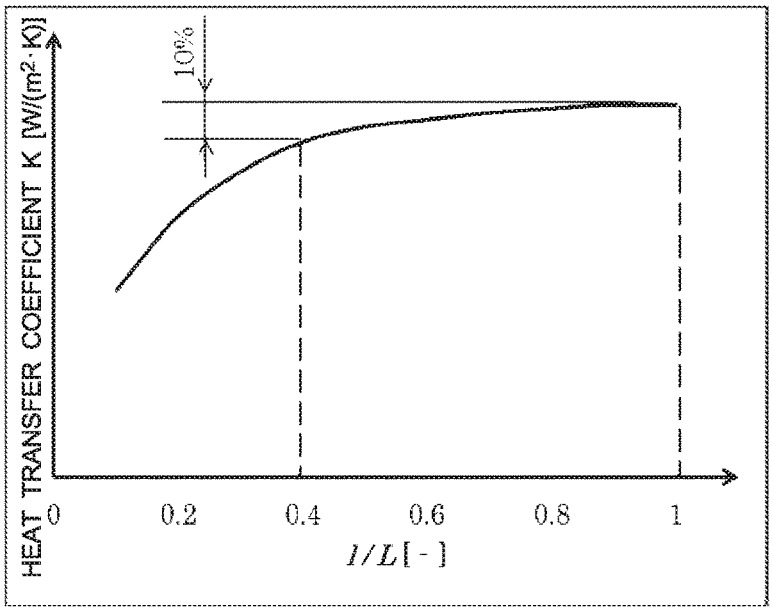
FIG. 6 is a characteristic view indicating an overall heat transfer coefficient in relation to a ratio between the perimeter of a cross-section of a heat transfer tube and the length of a contact area between the heat transfer tube and the flat fin.

The amount of protruding of the protrusion 45*a* corresponding to the protrusion portion 47*a* of the heat transfer tube 43*a* in embodiment 1 will be described. FIG. 5 is an enlarged sectional view illustrating part of the flat fin 41*a*. FIG. 6 is a characteristic diagram indicating the coefficient K of heat transferrin in relation to a ratio between the perimeter of a cross-section of the heat transfer tube 43*a* and the length of a contact area between the heat transfer tube 43*a* and the flat fin 41*a*. The ratio between the perimeter of the cross-section of the heat transfer tuber 43*a* and the length of the contact area between the heat transfer tube 43*a* and the flat fin 41*a* is an index indicating the amount of protrusion of the heat transfer tube 43*a*, and is expressed by I/L, where l is the length of the contact area between the flat fin 41*a* and the heat transfer tube 43*a*, and L is the perimeter of the cross-section of the heat transfer tube 43*a*. The heat transfer coefficient is an index indicating the performance of the heat exchanger.

In the case of using cylindrical tubes, unlike flat tubes, the cylindrical tubes have an outer periphery including no linear portion, and thus satisfy I/L 0.5 in order that a plurality of heat-exchanger cores be engaged with each other. In the case of using flat tubes, they have an outer periphery including linear portions, and can thus be manufactured in such a way as to satisfy I/L<0.5.

As indicated in the characteristic view of FIG. 6, when I/L is less than 0.4, an overall heat transfer coefficient is reduced by 10% or more. It is therefore necessary that I/L is greater than or equal to 0.4, that is, I/L≥0.4, in order that the percentage by which the performance of the heat exchanger is reduced be 10% or less. That is, in order that the performance of the heat exchanger be sufficiently fulfilled, it is preferable that in the case of forming the above protrusions, part of the heat transfer tube 43*a*, which corresponds to 40% or more of the perimeter of the cross-section of the heat transfer tube 43*a*, be inserted into the cut 44*a* of the flat fin 41*a*.

By virtue of the above configuration, it is possible to facilitate positioning of the heat-exchanger cores while maintaining the performance of the heat exchanger 100.

Embodiment 2

Figure 7:
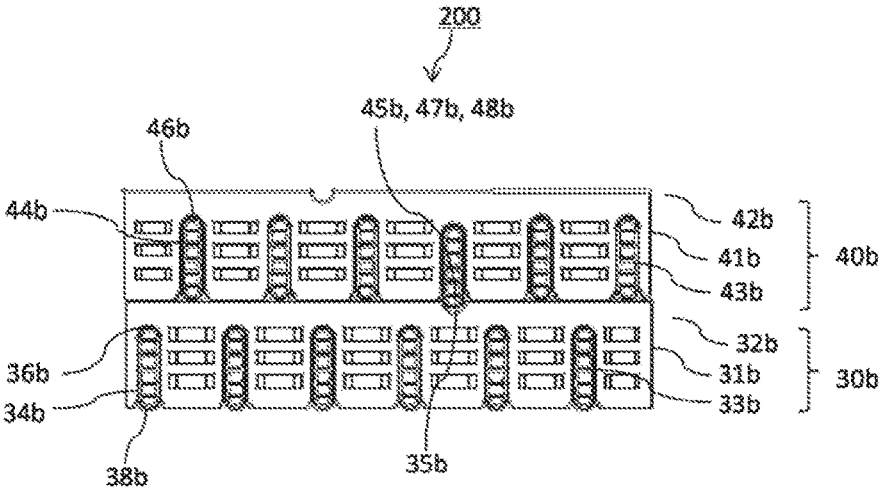
FIG. 7 is a sectional view of part of a heat exchanger according to embodiment 2.

FIG. 7 is a sectional view of part of a heat exchanger 200 according to embodiment 2. Embodiment 2 will be described mainly by referring to the difference between embodiments 1 and 2. With respect to embodiment 2, components identical or similar to those in embodiment 1 will be denoted by the same reference signs, and their explanations will thus be omitted.

In embodiment 1, all the heat transfer tubes 33*a* and 43*a* of the heat-exchanger cores 30*a* and 40*a* protrude from the flat fins. On the other hand, in embodiment 2, only one or more of heat transfer tubes protrude from flat fins, and serve as protrusion portions.

In a heat-exchanger core 30*b* having a recess or recesses, recesses 35*b* are not provided in respective spaces between a plurality of cuts 34*b*; i.e., one or more recesses 35*b* are intermittently provided, and arranged at positions which are offset relative to associated cuts 34*b* by the half the pitch P of the plurality of cuts 34*b*, that is, ½P, in the direction in which the cuts 34*b* are arranged. Furthermore, in a heat-exchanger core 40*b*, a protrusion or protrusions 45*b*, which fit in the recess or recesses 35*b*, are formed to face the recess or recesses 35*b*. In the heat-exchanger cores 30*b* and 40*b*, the cuts each have a depth equal to the length of the major axis of the cross-section of each of the heat transfer tubes. The heat transfer tubes 33*b* and 43*b* are inserted in the cuts 34*b* and 44*b* such that one end of each of the heat transfer tubes 33*b* and 43*b* is in contact with an associated one of deepest portions 36*b* and 46*b* of the cuts 34*b* and 44*b*, and each of arcuate portions 38*b* and 48*b* of the heat transfer tubes 33*b* and 43*b* do not protrude from an associated one of the cuts 34*b* and 44*b*. However, the cut 44*b* located in the position of the protrusion or protrusions 45*b* is shallower than the other cuts in such a manner that an associated heat transfer tube 43*b* protrudes from the cut 44*b*.

As described above, the cuts other than the cut for the protrusion or protrusion 45*b* each have a depth equal to the length of the major axis of the cross-section of the heat transfer tubes, such that each of the arcuate portions 38*b* and 48*b* do not protrude from the associated one of the cuts 34*b* and 44*b*; however, they may each have a depth which is greater than or equal to the length of the major axis of the cross-section of the heat transfer tubes such that so that each of the arcuate portions 38*b* and 48*b* do not protrude from the associated one of the cuts 34*b* and 44*b*.

Furthermore, in the above configuration, the cut 44*b* located in the position of the protrusion or protrusions 45*b* is shallower than the other cuts, such that the associated heat transfer tube 43*b* protrudes from the cut 44*b*; however, it may have the same depth as that of each of the other cuts, and the associated heat transfer tube 43*b* may be inserted into the cut 44*b* such that one end of the heat transfer tube 43*b* is located away from the deepest portion 46*b* of the cut 44*b*, and as a result the arcuate portion 48*b* of the associated heat transfer tube 43*b*, that is, the other end thereof, protrudes from the cut 44*b*.

In the heat exchanger 200 having the above configuration, the protrusion or protrusions 45*b*, which are protrusion portions of the heat transfer tube 43*b* of the heat-exchanger core 40*b*, and have a semicircular shape, fit in the recess or recesses 35*b* intermittently provided in the heat-exchanger core 30*b* and having a semicircular shape, whereby the heat-exchanger core 30*b* and the heat-exchanger core 40*b* are joined to each other to have a desired positional relationship.

In the above configuration, the recess or recesses 35*b* of the heat-exchanger core 30*b* are displaced from associated cuts 34*b* by half the pitch P of the cuts 34*b*, i.e., ½P, in the direction in which the cuts 34*b* are arranged. Since the protrusion or protrusions 45*b* of the heat-exchanger core 40*b* fit in the recess or recesses 35*b*, the heat transfer tubes 33*b* of the heat-exchanger core 30*b* and the heat transfer tubes 43*b* of the heat-exchanger core 40*b* are arranged in a staggered manner.

In the heat exchanger 200 according to embodiment 2, the cuts 34*b* and 44*b* each have a depth equal to the length of the major axis of the cross-section of each of the heat transfer tubes 33*b* and 43*b*. The heat transfer tubes 33*b* and 43*b* are inserted in the cuts 34*b* and 44*b* such that one end of each of the heat transfer tubes 33*b* and 43*b* is in contact with the associated one of the deepest portions 36*b* and 46*b* of the cuts 34*b* and 44*b*, and each of the arcuate portions 38*b* and 48*b* does not protrude from the associated one of the cuts 34*b* and 44*b*. Thus, the length l of each of the contact area between the heat transfer tube 33*b* and the flat fin 31*b* and the contact area between the heat transfer tube 43*b* and the flat fin 41*b* is greater than that in the configuration in embodiment 1 in which the heat transfer tubes 33*b* and 43*b* protrude from the flat fins 31*b* and 41*b*. Therefore, the amount of heat transferred from the heat transfer tubes 33*b* and 43*b* to the flat fins 31*b* and 41 is increased, thus improving the heat exchange performance of the heat exchanger 200.

The heat-exchanger cores are assembled such that the semicircular protrusion or protrusions 45*b*, which are the protrusion portions of the heat transfer tubes 43*b* of the heat-exchanger core 40*b*, fit in the semicircular recess or recesses 35*b* intermittently provided in the heat-exchanger core 30*b*. When the heat-exchanger cores are being assembled, if the protrusion 45*b* and the recess 35*b* are displaced from each other, they are not engaged with each other. It is therefore possible to prevent the heat-exchanger cores from being assembled at incorrect positions.

Embodiment 3

Figure 8:
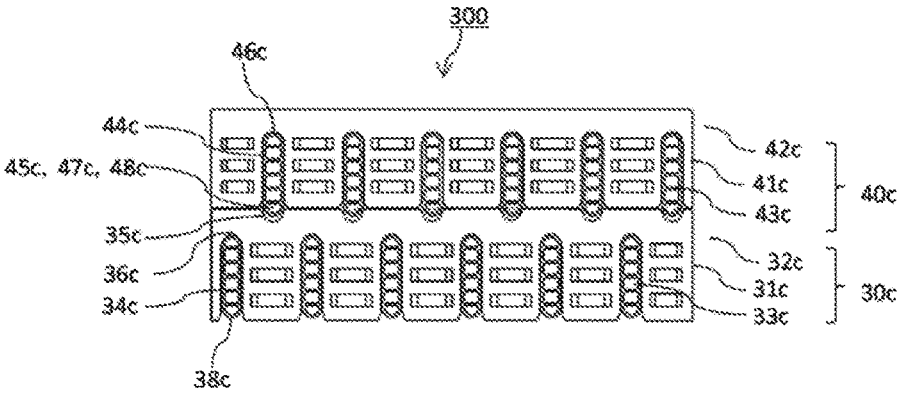
FIG. 8 is a sectional view of part of a heat exchanger according to embodiment 3.

FIG. 8 is a sectional view of part of a heat exchanger 300 according to embodiment 3. Embodiment 3 will be described mainly by referring to the difference between embodiments 1 and 3. With respect to embodiment 3, components identical or similar to those in embodiment 1 will be denoted by the same reference signs, and their explanations will thus be omitted.

In Embodiment 1, the two heat-exchanger cores both include recesses. By contrast, in embodiment 3, one of heat-exchanger cores joined to each other has no recess, since a further heat-exchanger core is not joined to the above one of the heat-exchanger cores.

A heat-exchanger core 30*c* having recesses is configured as follows: recesses 35*c* are located in respective spaces between cuts 34*c* and at respective positions which are offset relative to the cuts 34*c* by half the pitch P of the cuts 34*c*, that is, ½P, in a direction in which the cuts 34*c* are arranged. The cuts 34*c* each have a depth equal to the length of the major axis of the cross-section of heat transfer tubes 33*c*. The heat transfer tubes 33*c* are inserted in the cuts 34*c* such that that one side of each of the heat transfer tubes 33*c* is in contact with the deepest portion 36*c* of an associated one of the cuts 34*c*, and the arcuate portion 38*c* of each heat transfer tube 33*c* does not protrude from the associated cut 34*c*. By contrast, a heat-exchanger core 40*c* having protrusions has no recess on the opposite side of a side on which cuts 44*c* are arranged. That is, the heat-exchanger core 40*c* has a linearly flat side. Heat transfer tubes 43*c* are formed such that one end of each of the heat-transfer tubes 43*c* is in contact with the deepest portion 46*c* of an associated one of the cuts 44*c*, and arcuate portions 48*c* of the heat transfer tubes 43*c* protrude from the cuts 44*c* to form protrusions 45*c* of the heat-transfer core 40*c*.

In the heat exchanger 300 having the above configuration, the protrusions 45*c*, which are semicircular and correspond to protrusion portions of the heat transfer tubes 43*c* of the heat-exchanger core 40*c*, fit in the recesses 35*c*, which are semicircular and located in respective spaces between the cuts 34*c* in the heat-exchanger core 30*c*, whereby the heat-exchanger core 30*c* and the heat-exchanger core 40*c* are joined to each other to have a desired positional relationship.

In this case, in a direction in which the cuts 34 are arranged, the recesses 35*c* of the heat-exchanger core 30*c* are located at respective positions which are offset relative to the cuts 34*c* by half the pitch P of the cuts 34*c*, that is, ½P. Since the protrusions 45*c* of the heat-exchanger core 40*c* fit in the recesses 35*c*, the positional relationship between the heat transfer tubes 33*c* of the heat-exchanger core 30*c* and the heat transfer tubes 43*c* of the heat-exchanger core 40*c* are arranged in a staggered manner.

In the heat exchanger 300 according to embodiment 3, the heat-exchanger core 40*c* has no recess on the opposite side of the side on which the cuts 44*c* are arranged. This configuration is highly resistant to the pressure acting on the opposite side of the side in which the cuts 44*c* of flat fins 41*c* are arranged, thus reducing or preventing deformation or falling of the flat fins 41*c* and flat fins 31*c*.

The cuts 34*c* each have a depth equal to the length of the major axis of the cross-section of the heat transfer tubes 33*c*. The heat transfer tubes 33*c* are inserted in the cuts 34*c* such that one end of each of the heat transfer tubes 33*c* is in contact with the deepest portion 36*c* of the associated one of the cuts 34*c*, and each of the arcuate portions 38*c* thereof does not protrude from the associated one of the cuts 34*c*. Thus, the length l of the contact area between the heat transfer tube 33*c* and the flat fin 31*c* is greater than that in a configuration in which the heat transfer tube 33*c* protrudes from the flat fin 31*c*. Therefore, the amount of heat transferred from the heat transfer tube 33*c* to the flat fin 31*c* is increased, thus improving the heat exchange performance of the heat exchanger 300.

In embodiments 1 to 3, the recesses are semicircular. However, the shape of the recesses is not limited to the semicircular shape. The recesses may be rectangular or V-shaped.

Also, it is described above that the protrusions are the protrusion portions of the heat transfer tubes. The flat fins may be formed to include protrusion portions, and the protrusion portions may be applied as the above protrusions.

The number of recesses provided in the heat-exchanger core having a recess or recesses, whether or not the heat-exchanger core includes a recess or recesses, and whether or not the heat-exchanger core including a protrusion or protrusions includes a recess or recesses are not limited to those of the above configurations. On this point, the above configurations may be combined.

Embodiment 4

Figure 9:
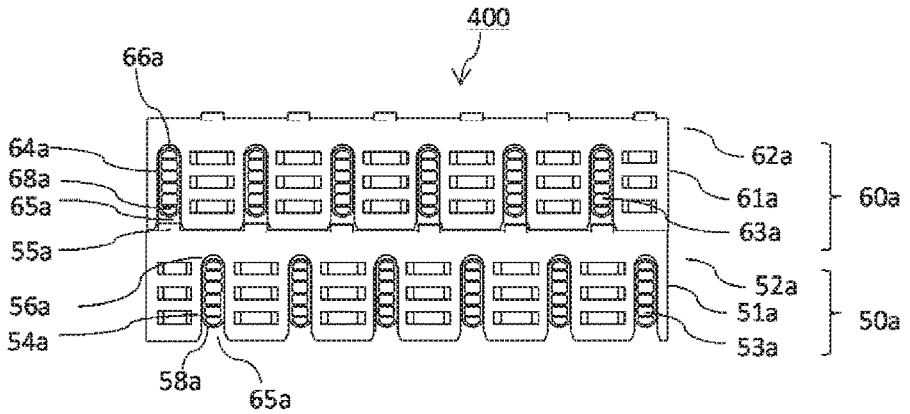
FIG. 9 is a sectional view of part of a heat exchanger according to embodiment 4.

FIG. 9 is a sectional view of part of a heat exchanger 400 according to embodiment 4. Embodiment 4 will be described mainly by referring to the difference between embodiments 1 and 4. With respect to embodiment 4, components identical or similar to those in embodiment 1 will be denoted by the same reference signs, and their explanations will thus be omitted.

In the heat exchanger 100 according to embodiment 1, the heat-exchanger core 30*a* which is a first heat-exchanger core having recesses and the heat-exchanger core 40*a* which is a second heat-exchanger core having protrusions are joined to each other. By contrast, in a heat exchanger 400 according to embodiment 4, a heat-exchanger core 50*a* which is a third heat-exchanger core having protrusions and a heat-exchanger core 60*a* which is a fourth heat-exchanger core having recesses are joined to each other.

The heat-exchanger core 50*a* having the protrusions includes a fin body 52*a* in which flat fins 51*a* are provided, and heat transfer tubes 53*a*. Each of the flat fins 51*a* has a plurality of cuts 54*a* which are provided in one of sides extending in a longitudinal direction, and which are arranged at regular intervals, and rectangular protrusions 55*a* which are provided on the other side, i.e., the opposite side of the above one side. The cuts 54*a* are elongated and allow the heat transfer tubes 53*a* to be inserted into the cuts 54*a*. The protrusions 55*a* are rectangular, and are located at respective positions which are offset relative to the cuts 54*a* by half the pitch P of the cuts 54*a*, i.e., ½P, in a direction in which the cuts 54*a* are arranged. The flat fins 51*a* are arranged in a direction in which passages provided in the heat transfer tubes 53*a* extend (or in a direction perpendicular to the plane of FIG. 9), thereby forming the fin body 52*a*. The heat transfer tubes 53*a* are inserted into the cuts 54*a* of the fin body 52*a*, thereby forming the heat-exchanger core 50*a*. As illustrated in FIG. 9, the cuts 54*a* have a depth greater than the length of the major axis of the cross-section of the heat transfer tubes 53*a*. Each of the heat transfer tubes 53*a* is inserted in an associated one of the cuts 54*a* such that one end of each heat transfer tube 53*a* is in contact with the deepest portion 56*a* of the associated cut 54*a*. Therefore, the other end of each heat transfer tube 53*a*, that is, an arcuate portion 58*a*, does not protrude from the associated cut 54*a* and is located inward of one side of the fin body 52*a*. In the cut 54*a*, the arcuate portion 58*a* of each heat transfer tube 53*a* and the above one end of the fin body 52*a* define a recess 65*a*.

The heat-exchanger core 60*a* having the recesses has the same configuration as or a similar configuration to that of the heat-exchanger core 50*a*, except for the both ends of the flat fins in the longitudinal direction thereof. The heat-exchanger core 60*a* includes a fin body 62*a* in which flat fins 61*a* are provided, and heat transfer tubes 63*a*. Cuts 64*a* each have a depth greater than the length of the major axis of the cross-section of each of the heat transfer tubes 63*a*. In each of the cuts 64*a*, arcuate portion 68*a* of the heat transfer tube 63*a* and one side of the fin body 62*a* define a recess 65*a* as in the heat-exchanger core 50*a*.

In the heat exchanger 400 having the above configuration, the protrusions 55*a* provided on the heat-exchanger core 50*a* fit in the recesses 65*a* of the heat-exchanger core 60*a*, whereby the heat-exchanger core 50*a* and the heat-exchanger core 60*a* are joined to each other to have a desired positional relationship.

In the above configuration, in the direction in which the cuts 54*a* are arranged, the protrusions 55*a* of the heat-exchanger core 50*a* are located at respective positions which are offset relative to the cuts 54*a* by half the pitch P of the cuts 54*a*, i.e., ½P. Since the protrusions 55*a* fit in the recesses 65*a* of the heat-exchanger core 60*a*, the heat transfer tubes 53*a* of the heat-exchanger core 50*a* and the heat transfer tubes 63*a* of the heat-exchanger core 60*a* are alternately arranged in a staggered manner.

The heat exchanger 400 according to embodiment 4 includes the heat-exchanger core 50*a* and the heat-exchanger core 60*a*. The heat-exchanger core 50*a* includes the cuts 54*a* which are provided on the one-end sides of the flat fins 51*a*, and into which the heat transfer tubes 53*a* are inserted, and the recesses 55*a* which are rectangular and provided on the other-end sides of the flat fins 51*a*. The heat-exchanger core 60*a* includes the recesses 65*a* which are provided on the one-end side of the flat fins 61*a*, and in which protrusions 55*a* fit. It is therefore possible to obtain the heat exchanger 400 in which the heat exchanger cores are easily positioned. Also, it is possible to easily assemble the heat exchanger 400 such that the heat exchange cores maintain a desired positional relationship, without using a positioning plate or a jig.

Furthermore, the protrusions 55*a* and each flat fin 51*a* are formed integrally with each other, and in each cut 64*a*, the recess 65*a* is defined by the arcuate portion 68*a* of the heat transfer tube 63*a* and one side of the fin body 62*a*. It is therefore possible to reduce the number of elements for connecting the heat-exchanger cores together or connecting the heat exchanger and a housing. Thus, it is possible to facilitate assemblage, and reduce the time required for assemblage and the cost.

The cuts 54*a* each have a depth greater than the length of the major axis of the cross-section of the heat transfer tubes 53*a*, and the heat transfer tubes 53*c* are inserted in the cuts 54*c* such that the heat transfer tubes 53*c* do not protrude from the cuts 54*c*. Therefore, the length l of the contact area between the heat transfer tube 53*c* and the flat fin 51*c* is greater than that in a configuration in which the heat transfer tube 53*c* protrudes from the flat fin 51*c*. Therefore, the amount of heat transferred from the heat transfer tube 53*c* to the flat fin 51*c* is increased, thus improving the heat exchange performance of the heat exchanger 400. In addition, since the flat fins 51*c* and the flat fins 61*a* include the rectangular protrusions, the effective heat transfer area is larger, thus improving the heat exchange performance of the heat exchanger 400.

Embodiment 5

Figure 10:
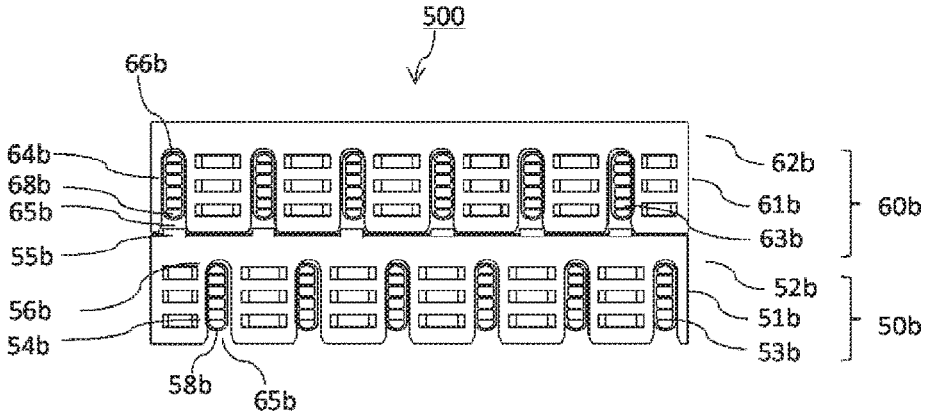
FIG. 10 is a sectional view of part of a heat exchanger according to embodiment 5.

FIG. 10 is a sectional view of part of a heat exchanger 500 according to embodiment 5. Embodiment 5 will be described mainly by referring to the difference between embodiments 4 and 5. With respect to embodiment 5, components identical or similar to those in embodiment 4 will be denoted by the same reference signs, and their explanations will thus be omitted.

In embodiment 4, the two heat-exchanger cores both have the protrusions. By contrast, in embodiment 5, a heat-exchanger core 60*b*, which is one of heat-exchanger cores joined to each other, has no protrusion on the opposite side of a side on which recesses 65*b* are arranged, since a further heat-exchanger core is not joined to the heat-exchanger core 60*b*.

A heat-exchanger core 50*b* having protrusions is configured such that protrusions 55*b* are located in respective spaces between cuts 54*b* and in respective positions which are offset relative to the cuts 54*b* by half the pitch P of the cuts 54*b*, i.e., ½P, in a direction in which the cuts 54*b* are arranged. The heat-exchanger core 60*b* having recesses has no protrusion on the opposite side of a side on which cuts 64*b* are provided. In other words, the heat-exchanger core 60*b* has a linear flat side. In the heat-exchanger cores 50*b* and 60*b*, the cuts each have a depth greater than the length of the major axis of the cross-section of the heat transfer tubes, and the heat transfer tubes are inserted in the cuts such that one end of each of the heat transfer tubes is in contact with the deepest portion of an associated one of the cuts. Therefore, in each heat transfer tube, an arcuate portion, which is the other end of the each transfer tube, does not protrude from the associated cut, and is located inward of one side of a fin body. In the cut, the arcuate portion of the heat transfer tube and the one side of the fin body define a recess.

In the heat exchanger 500 having the above configuration, the protrusions 55*b* provided on the heat-exchanger core 50*b* fit in the recesses 65*b* of the heat-exchanger core 60*b*, whereby the heat-exchanger core 50*b* and the heat-exchanger core 60*b* are joined to each other to have a desired positional relationship.

In the heat exchanger 500 according to embodiment 5, the heat-exchanger core 60*b* has no protrusion on the side opposite of the side on which the cuts 64*b* are arranged. Such a configuration is highly resistant to the pressure acting on the opposite side of the side on which the cuts 64*b* of flat fins 61*b* are arranged, and can thus prevent or reduce deformation and falling of the flat fins 61*b* and flat fins 51*b*.

In embodiments 4 and 5, the protrusions 55*a* and 55*b* are rectangular, but their shapes are not limited to the rectangular shape. The protrusions may be formed semicircular or V-shaped.

As described above, the cuts of the heat-exchanger cores each have a depth greater than the length of the major axis of the cross-section of the heat transfer tubes. In the heat-exchanger cores 50*a* and 50*b* having the protrusions, it is not indispensable that the recess is defined by the arcuate portion of the heat transfer tube and one side of the fin body in each of the cuts 54*a* and 54*b*. For example, the cuts 54*a* and 54*b* may be formed to have a depth greater than or equal to the length of the major axis of the cross-section of each of the heat transfer tubes 53*a* and 53*b*.

Embodiment 6

In embodiments 1 to 5, the recesses and protrusions formed at the flat fins are provided by cutting part of the flat fins. By contrast, in embodiment 6, at recesses provided in each of flat fins, fin collars are formed in such a way as to be raised from a flat surface of the fin.

Figure 11:
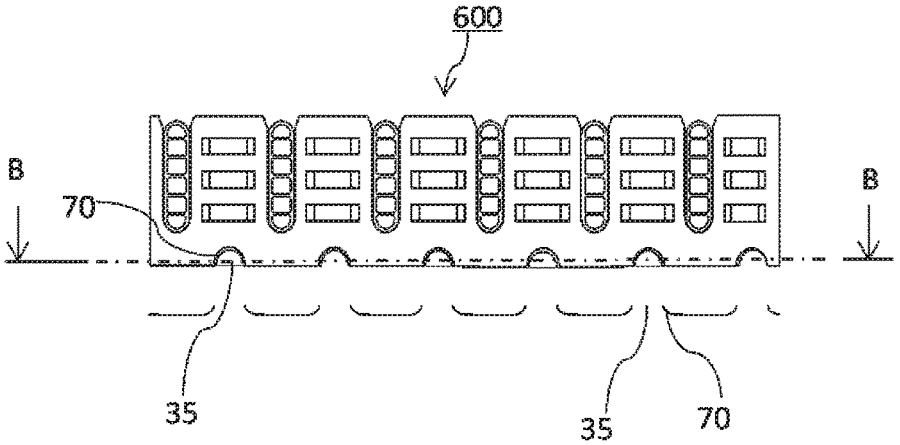
FIG. 11 is a sectional view of part of a heat exchanger according to embodiment 6.

FIG. 11 is a sectional view of part of a heat exchanger 600 according to embodiment 6. Lower part of FIG. 11 is a sectional view of a flat fin included in the heat exchanger 600, which is taken along line B-B in FIG. 11. Embodiment 6 will be described mainly by referring to the difference between embodiments 1 and 6. With respect to embodiment 6, components identical or similar to those in embodiment 1 will be denoted by the same reference signs, and their explanations will thus be omitted.

In a heat-exchanger core having semicircular recesses 35*a*, at peripheries of the recesses 35*a*, fin collars 70 are raised from a flat surface of the fin.

When the heat-exchanger core 30*a*, which is a first heat-exchanger core having recesses, and the heat-exchanger core 40*a*, which is a second heat-exchanger core having protrusions, are joined to each other, the protrusions 45*a* which are the protrusion portions 47*a* of the heat transfer tubes 43*a* are fitted into the recesses 35*a* having the fin collars 70. Thereby, the fin collars 70 come into contact with the heat transfer tubes 43*a*.

While the fin collars 70 are in contact with the heat transfer tubes 43*a*, furnace brazing is performed, as a result of which the recesses 35*a* having the fin collars 70 are brazed to the protrusions 45*a* which are the protrusion portions 47*a* of the heat transfer tubes 43*a*.

When the fin collars 70 come into contact with the heat transfer tubes 43*a*, the contact area between the flat fins 31*a* and the heat transfer tubes 43*a* increases, thereby increasing a heat transfer area, and thus also increasing the amount of heat transfer. Therefore, the heat exchange performance of the heat exchanger 600 can be improved.

In addition, since the recesses 35*a* are brazed to the protrusions 45*a*, the heat exchange performance can be enhanced.

Although embodiment 6 is described above by referring to the case where the heat exchanger 100 according to embodiment 1 is applied, it is not limited to such a case, and the heat exchanger according to embodiment 6 may have any configuration so long as the heat-exchanger core has recesses provided with fin collars.

It is described above that in all embodiments 1 to 6 of the present invention, the heat transfer tubes are provided in a staggered manner such that the heat transfer tubes are offset relative to each other by half the distance between the cuts in the direction in which the cuts are arranged. However, it is not indispensable that the distance by which the heat transfer tubes are offset relative to each other is half the distance between the cuts. Each of the heat transfer tubes may be aligned with an associated one of the heat transfer tubes.

Furthermore, although the heat exchanger including the flat tubes and the air-conditioning-apparatus outdoor unit including the heat exchanger are described above, the heat transfer tubes are not limited to flat tubes. The heat exchanger may be a heat exchanger including cylindrical tubes or a heat exchanger including a combination of flat tubes and cylindrical tubes. In this case, it is preferable that cuts be shaped such that contact areas between the cylindrical tubes and the flat fins are large.

In addition, although in the above configurations, only two heat-exchanger cores are provided, needless to say, the present invention is also applicable to a case where three or more heat-exchanger cores are joined to each other.

INDUSTRIAL APPLICABILITY

The heat exchanger according to the present invention can be widely used as heat exchangers of air-conditioning apparatuses for domestic use and business use, etc.

The invention claimed is:

1. A heat exchanger comprising:

a first heat-exchanger core including first heat transfer tubes containing first respective refrigerant passages, and first flat fins, each of the first flat fins having one side along a longitudinal direction of the first flat fin and an other side along the longitudinal direction of the first flat fin and being opposite to the one side, the each of the first flat fins having first cuts spaced from each other on the one side, the first cuts allowing the first heat transfer tubes to be inserted into the first cuts, the first flat fins being arranged in a direction in which the first respective refrigerant passages in the first heat transfer tubes extend, at least one of the first flat fins including a first recess or first recesses or a first protrusion or first protrusions on the other side; and a second heat-exchanger core including second heat transfer tubes containing second respective refrigerant passages, and second flat fins, each of the second flat fins having second cuts spaced from each other on one side of the each of the second flat fins, the second cuts allowing the second heat transfer tubes to be inserted into the second cuts, the second flat fins being arranged in a direction in which the second respective refrigerant passages in the second heat transfer tubes extend, the second heat-exchanger core being shaped to include a second protrusion or second protrusions or a second recess or second recesses on the one side of the each of the second flat fins, on which the second cuts are formed, the second protrusion or second protrusions being protruded portions of the second heat transfer tubes that protrude in a direction perpendicular to a plane of the each of the second flat fins and being fitted in the first recess or first recesses of the at least one of the first flat fins, the second recess or second recesses allowing the first protrusion or first protrusions being protruded portions of the first heat transfer tubes that protrude in a direction perpendicular to a plane of the at least one of the first flat fins to be fitted in the second recess or second recesses, the first recess or first recesses or the first protrusion or first protrusions of the at least one of the first flat fins being in contact with the second flat fins without an adhesive.

2. The heat exchanger of claim 1, wherein the second heat-exchanger core includes the second protrusions, wherein the second protrusions of the second heat-exchanger core are protruded portions of the second heat transfer tubes that protrude from the second cuts.

3. The heat exchanger of claim 1, wherein the second heat-exchanger core includes the second recesses, wherein the second recesses of the second heat-exchanger core are included in the second cuts.

4. The heat exchanger of claim 1, wherein the first cuts and the second cuts are arranged in a staggered manner in a longitudinal direction of the first flat fins and the second flat fins.

5. The heat exchanger of claim 2, wherein the first flat fins include the first recesses, wherein the first recesses formed in the first flat fins allow the protruded portions of the second heat transfer tubes that protrude from the second cuts to fit in the first recesses of the first flat fins, and the first recesses formed in the first flat fins include fin collars which are formed at peripheries of the first recesses to be raised from flat surfaces of the first flat fins.

6. An air-conditioning apparatus comprising the heat exchanger of claim 1.

7. An air-conditioning apparatus comprising the heat exchanger of claim 2.

8. An air-conditioning apparatus comprising the heat exchanger of claim 3.

9. An air-conditioning apparatus comprising the heat exchanger of claim 4.

10. An air-conditioning apparatus comprising the heat exchanger of claim 5.

* * * * *